US006520057B1

(12) United States Patent
Steadman

(10) Patent No.: US 6,520,057 B1
(45) **Date of Patent: *Feb. 18, 2003**

(54) CONTINUOUS SYSTEM AND METHOD FOR CUTTING SHEET MATERIAL

(75) Inventor: Erich F. Steadman, Williamsville, NY (US)

(73) Assignee: Eastman Machine Company, Buffalo, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/941,891

(22) Filed: Sep. 30, 1997

(51) Int. Cl.[7] ..... B26D 1/56; B26D 5/20

(52) U.S. Cl. ..... 83/76.8; 83/303; 83/365; 83/367; 83/368; 83/940; 700/134

(58) Field of Search ..... 83/23, 76.8, 271, 83/368, 409, 649, 37, 55, 76.1, 155, 236, 298, 303, 331, 483, 937, 938, 939, 940, 941, 755, 40, 50, 367, 370, 365; 700/134, 135

(56) References Cited

U.S. PATENT DOCUMENTS 4,476,756 A * 10/1984 Pearl et al. ..... 83/152
4,934,228 A * 6/1990 Bolton et al. ..... 83/23
4,994,979 A * 2/1991 Bruder et al. ..... 83/940
5,119,704 A * 6/1992 Wolfson ..... 83/155
5,146,821 A * 9/1992 Bruder et al. ..... 83/40
5,189,934 A * 3/1993 Davidson et al. ..... 83/151
5,214,590 A * 5/1993 Schnetzer ..... 83/940
5,258,917 A * 11/1993 Bruder et al. ..... 348/125
5,388,488 A * 2/1995 Geidl et al. ..... 83/76.8
5,699,707 A * 12/1997 Campbell, Jr. ..... 83/152
5,836,224 A * 11/1998 Gerber ..... 83/941
5,838,569 A * 11/1998 Gane ..... 700/134
5,873,392 A * 2/1999 Meyer et al. ..... 83/76.8
5,953,232 A * 9/1999 Blaimschein ..... 382/111
6,205,370 B1 * 3/2001 Blaimschein et al. ..... 83/940

* cited by examiner

*Primary Examiner*—Allan N. Shoap
*Assistant Examiner*—Stephen Choi
(74) *Attorney, Agent, or Firm*—Hodgson Russ LLP

(57) ABSTRACT

A system and method for performing operations such as cutting on sheet material such as cloth wherein the sheet material is scanned at an inspection station to determine the existence and location of flaws in the material, the material is transferred to a conveyor where operations such as cutting are performed on the sheet material as it is moved by the conveyor, and the speed of the conveyor and the speed, direction and mode of the operations are controlled all according to a predetermined pattern of operation for the sheet material and the pattern can be re-nested or adjusted in accordance with the existence and location of flaws in the material as determined by the scanning. The operations are performed by controlled gantry-style cutters, and preferably two such cutters are employed wherein a control determines the conveyor speed and determines the portions of the cutting operation to be performed by the respective cutters.

4 Claims, 12 Drawing Sheets

CONTINUOUS SYSTEM AND METHOD FOR CUTTING SHEET MATERIAL

BACKGROUND OF THE INVENTION

This invention relates to the art of performing operations such as cutting on sheet material such as cloth, and more particularly to a new and improved continuous system and method for cutting sheet material such as cloth.

One area of use of the present invention is in performing cutting, punching, marking and other operations on cloth, but the principles of the present invention can be variously applied to other types of sheet material such as leather hides, cloth laminates and the like. In cutting and otherwise operating on such sheet material at least two important objectives are reducing waste of the material and increasing throughput of the system and method. It would, therefore, be highly desirable to provide, in accordance with the present invention, a continuous system and method to increase throughput and having the capability of adjusting the pattern of operations to minimize waste of the material.

SUMMARY OF THE INVENTION

It is therefore, a primary object of this invention to provide a new and improved system and method for performing operations such as cutting on sheet material such as cloth.

It is a more particular object of this invention to provide such a system and method which yields increased throughput.

It is a more particular object of this invention to provide such a system and method which minimizes waste of the sheet material.

It is a further object of this invention to provide such a system and method wherein the operation is adjusted to compensate for flaws in the sheet material.

It is a further object of this invention to provide a new and improved conveyor for use in such a system and method.

It is a further object of this invention to provide a new and improved tool assembly for use in such a system and method.

The present invention provides a system and method for performing operations such as cutting on sheet material such as cloth wherein the sheet material is scanned at an inspection station to determine the existence and location of flaws in the material, the material is transferred to a conveyor where operations such as cutting are performed on the sheet material as it is moved by the conveyor, and the speed of the conveyor and the speed, direction and mode of the operations are controlled all according to a predetermined pattern of operation for the sheet material and the pattern is re-nested or adjusted in accordance with the existence and location of flaws in the material as determined by the scanning. The "on-the-fly" cutting of the material greatly increases system throughput, and the renesting of the pattern greatly reduces waste of material. The operations are performed by computer-controlled gantry-style cutters, and preferably two such cutters are employed wherein the portions of the cutting operation to be performed by the respective cutters are computer-controlled. The conveyor table provides vacuum or suction hold-down of the material, includes an outer belt of perforated flexible material and an inner belt of rigid link structure wherein the inner belt is moved by the conveyor drive means and the outer belt is moved by engagement with the inner belt. A controlled tool assembly on the head of each gantry-style cutter moves a tool, such as a cutting blade, into and out of engagement with and in different orientations with respect to the sheet material.

The foregoing and additional advantages and characterizing features of the present invention will become clearly apparent upon a reading of the ensuing detailed description together with the included drawing wherein:

BRIEF DESCRIPTION OF THE DRAWING FIGURES

Figure 1:
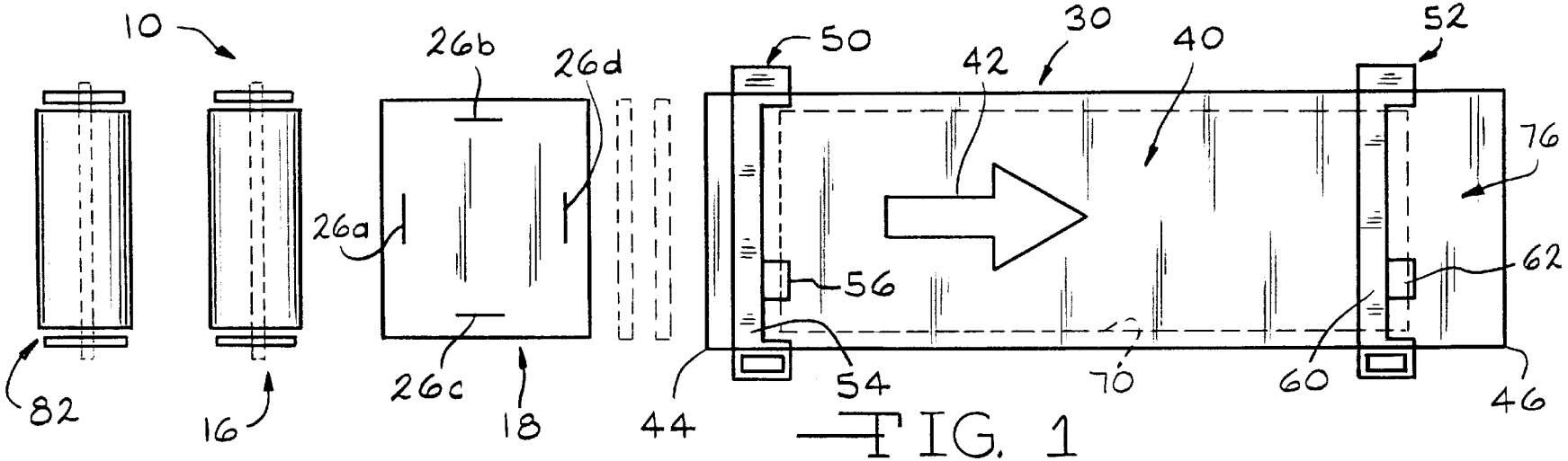
FIG. 1 is a diagrammatic top plan view of a system according to the present invention for "on-the-fly" scanning, digitizing, nesting and cutting sheet material such as cloth.
Figure 2:
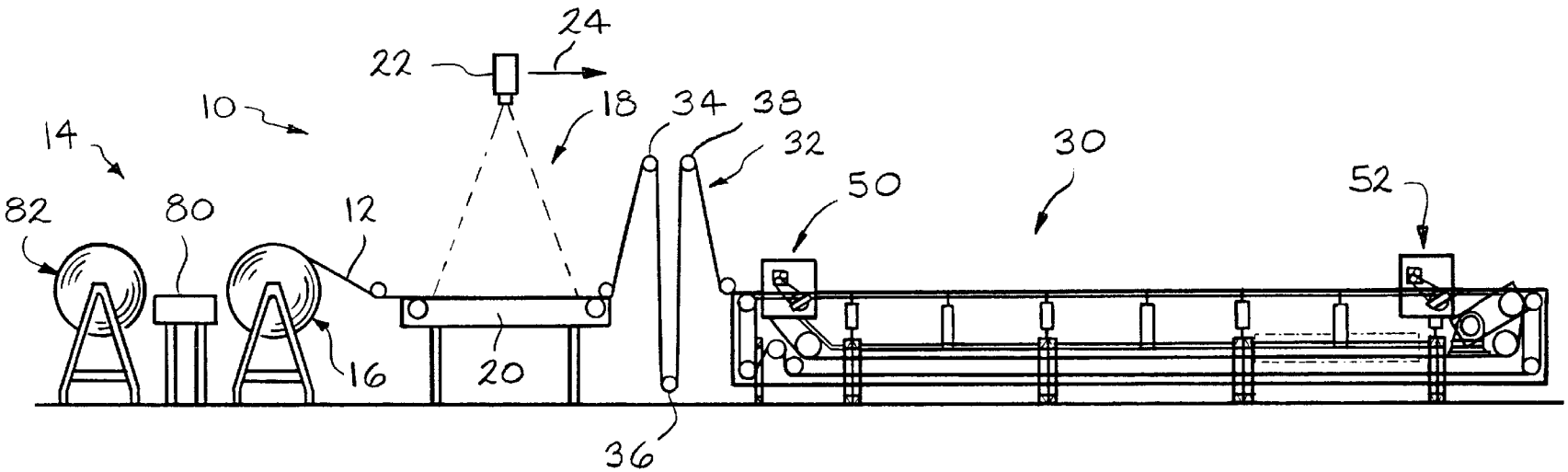
FIG. 2 is a diagrammatic side elevational view of the system of FIG. 1.
Figure 3:
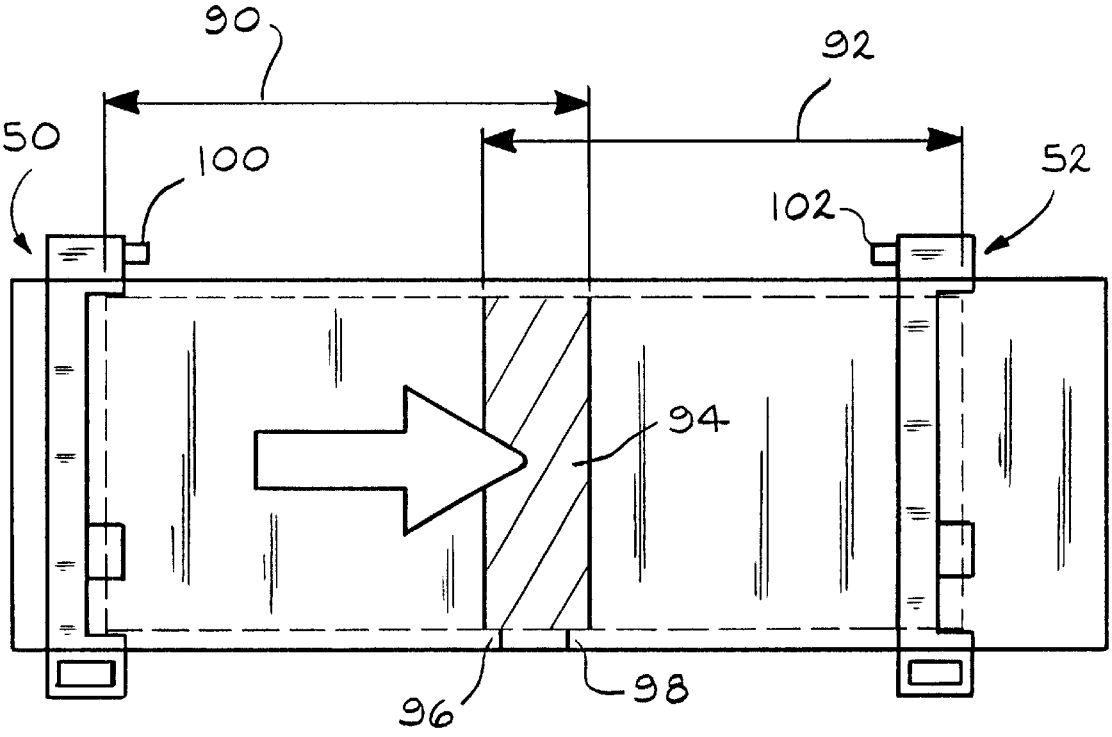
FIG. 3 is an enlarged diagrammatic top plan view with parts removed illustrating operation of the system of FIGS. 1 and 2.
Figure 8:
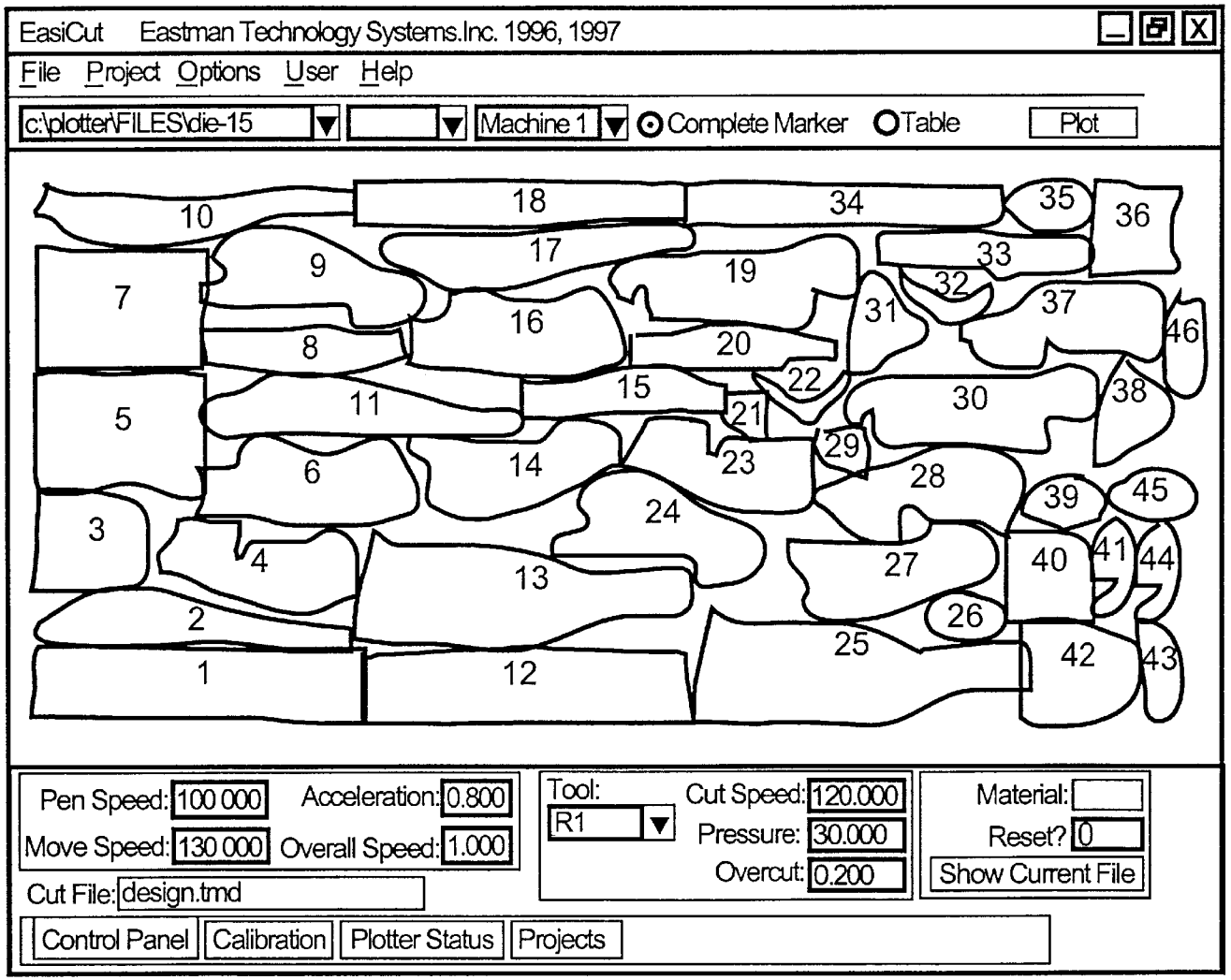
Figure 9:
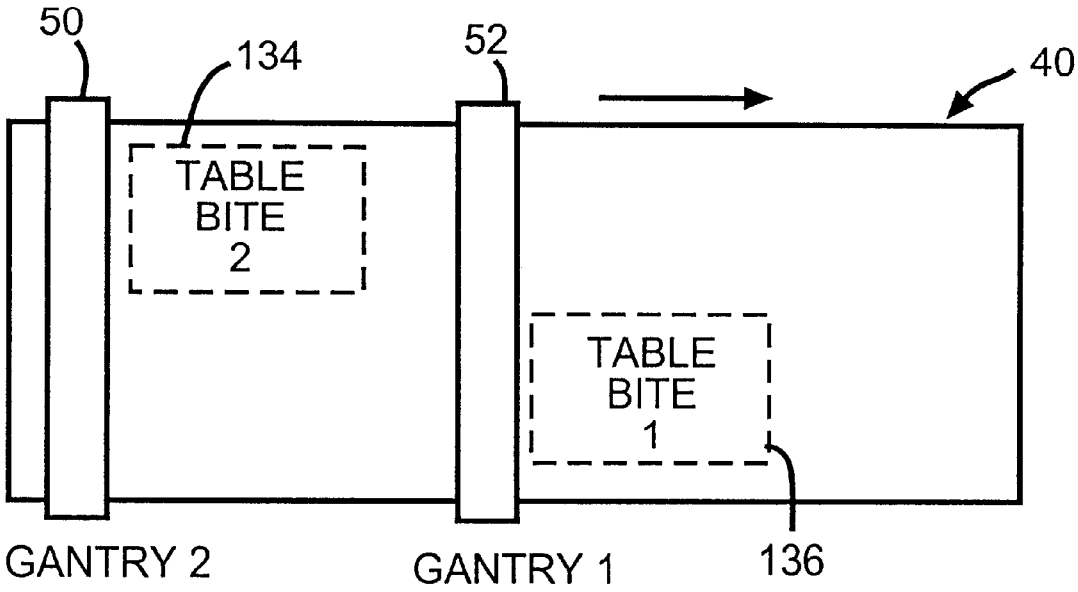
Figure 10:
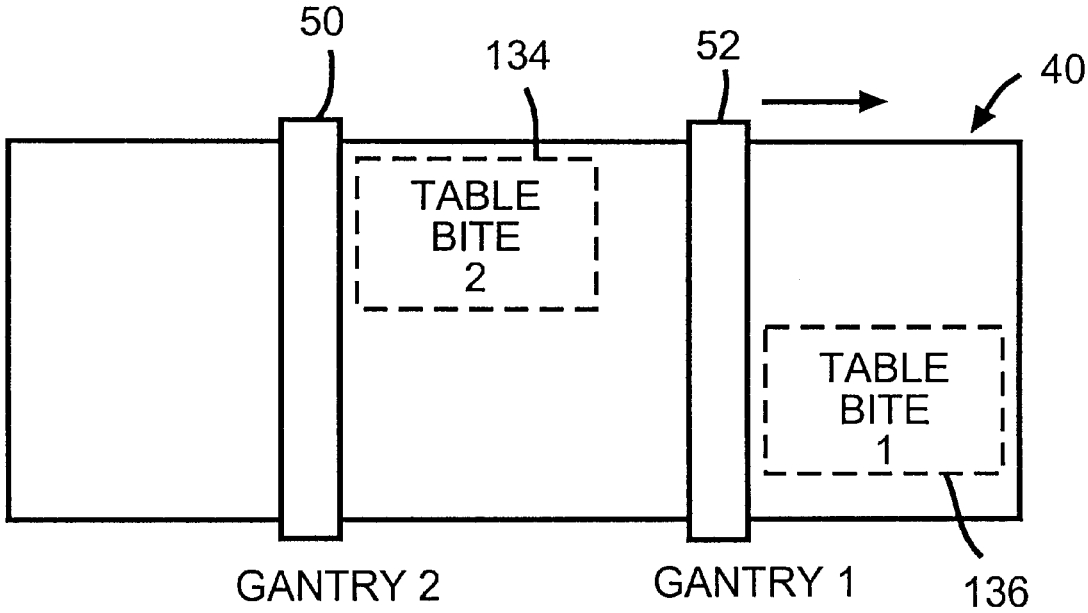
Figure 11:
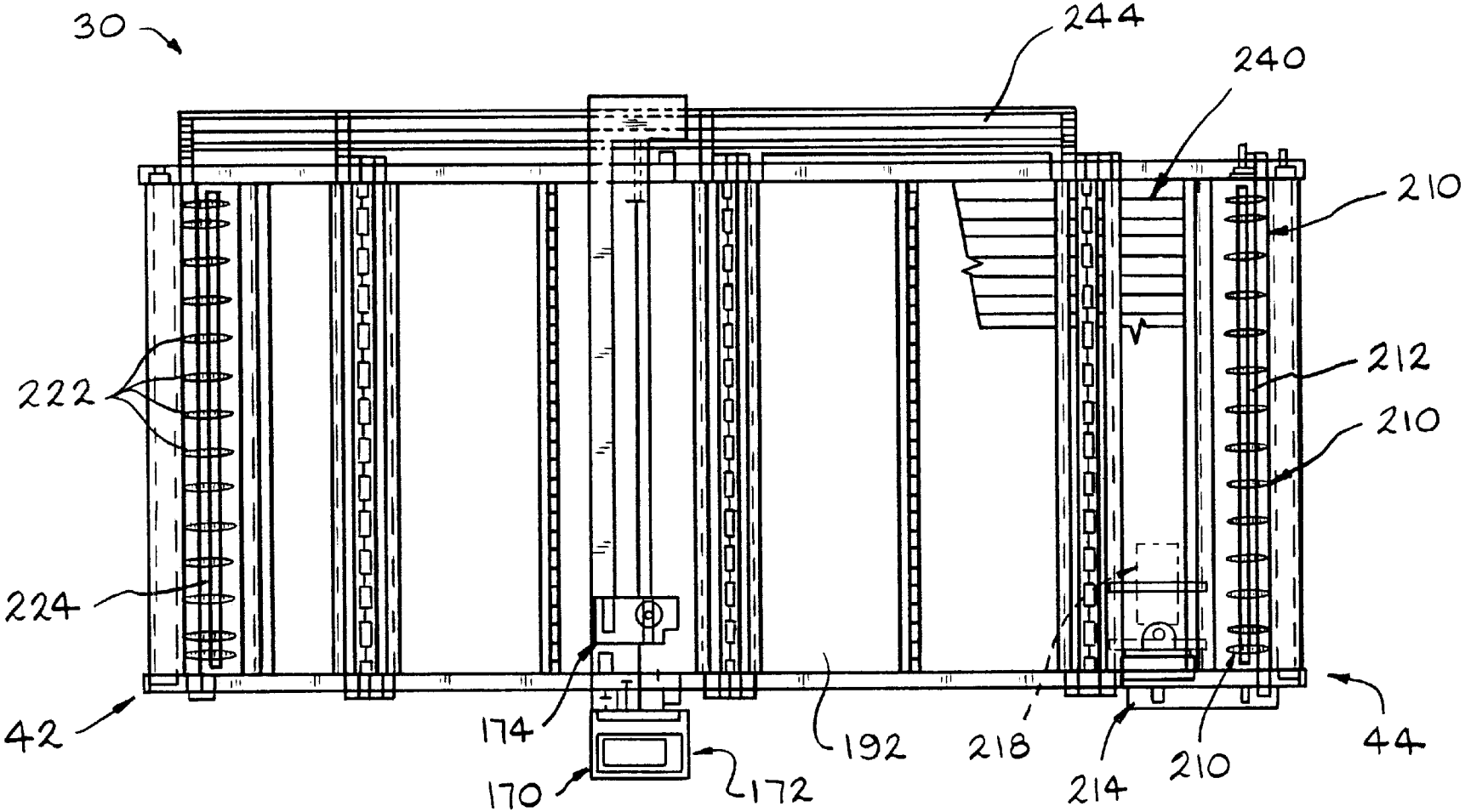
Figure 12:
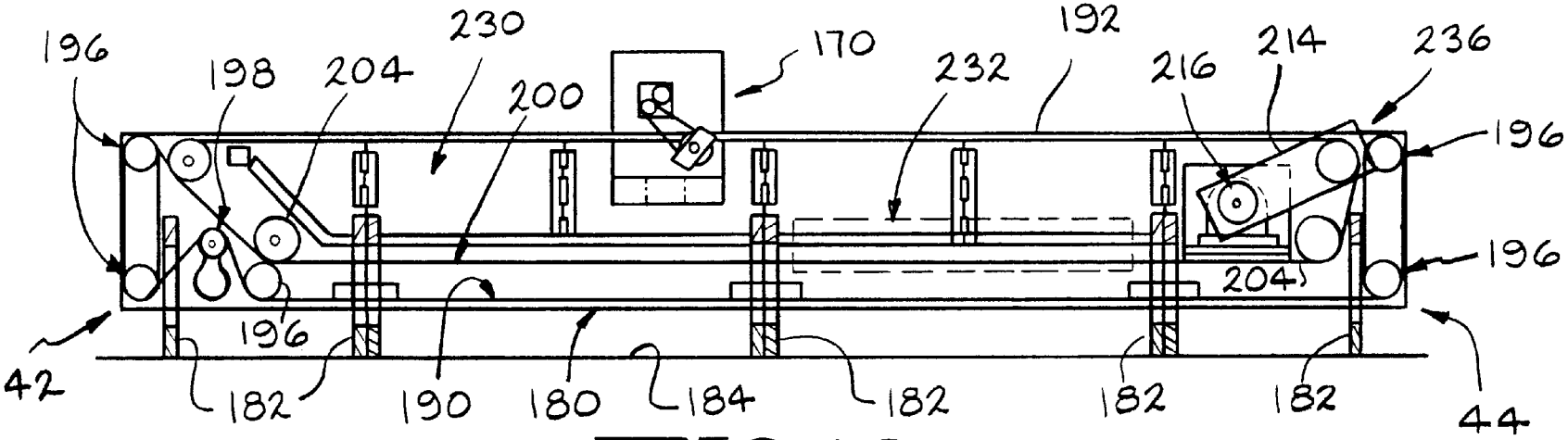
Figure 13:
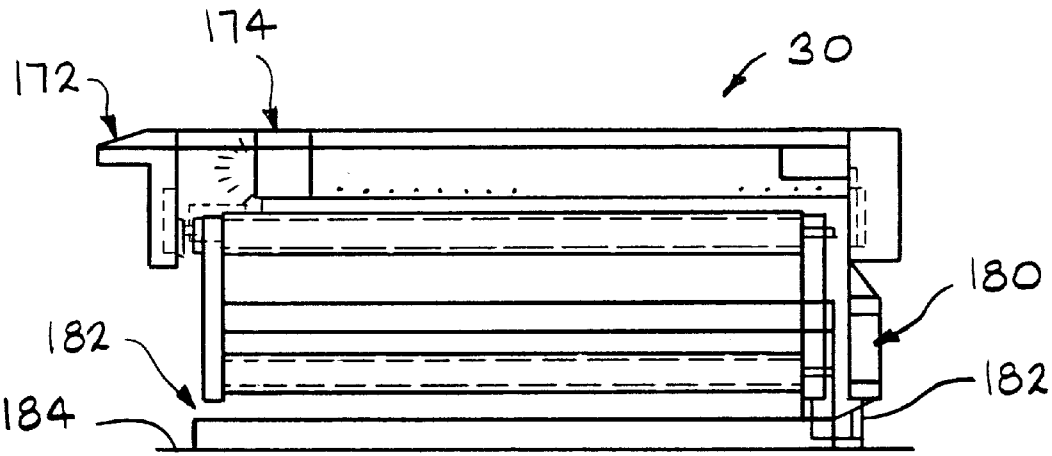
Figure 14:
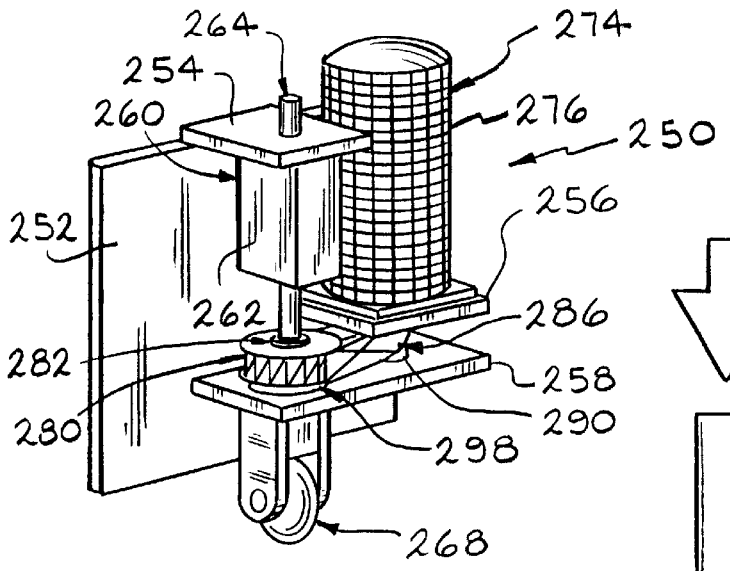
Figure 15:
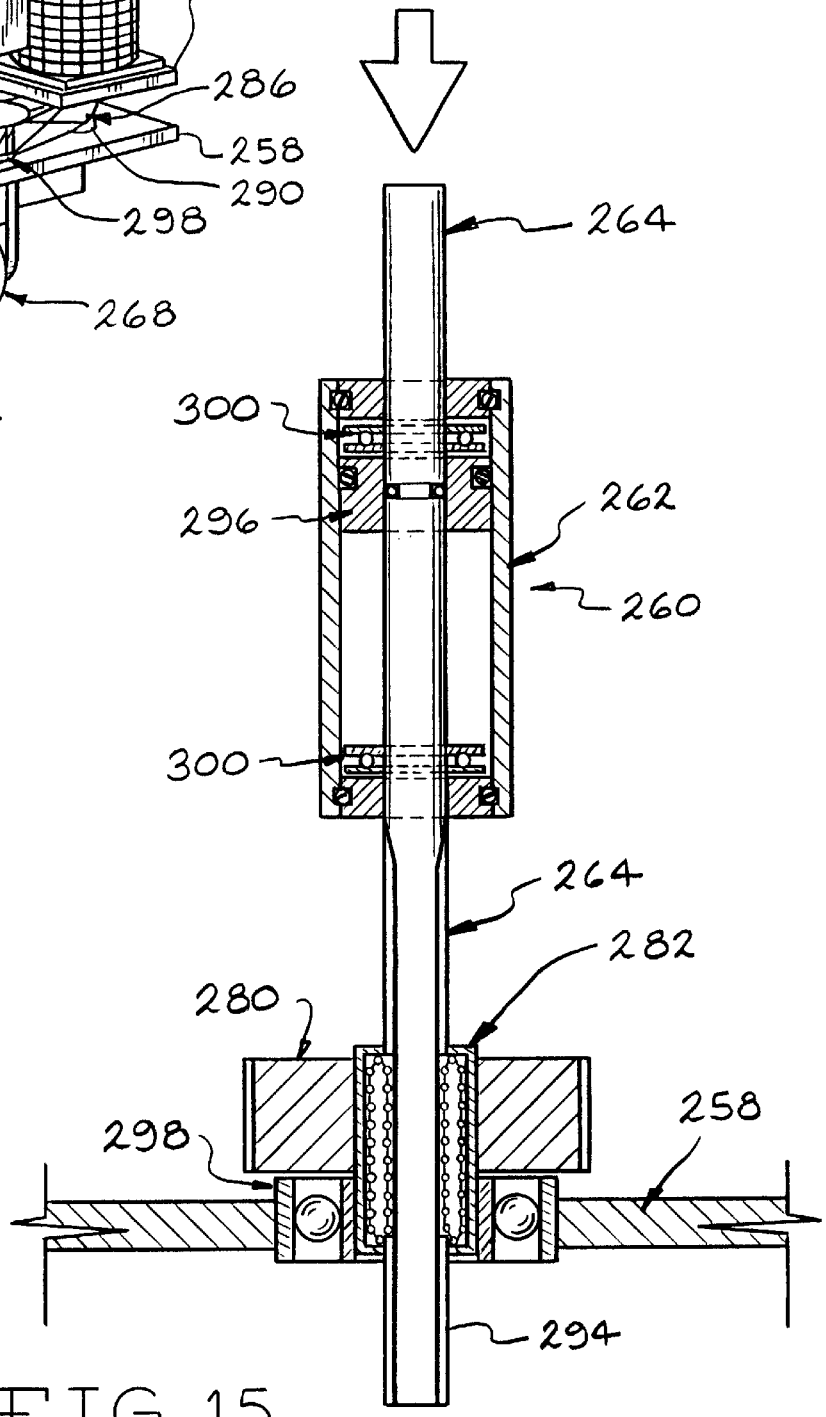
Figure 16:
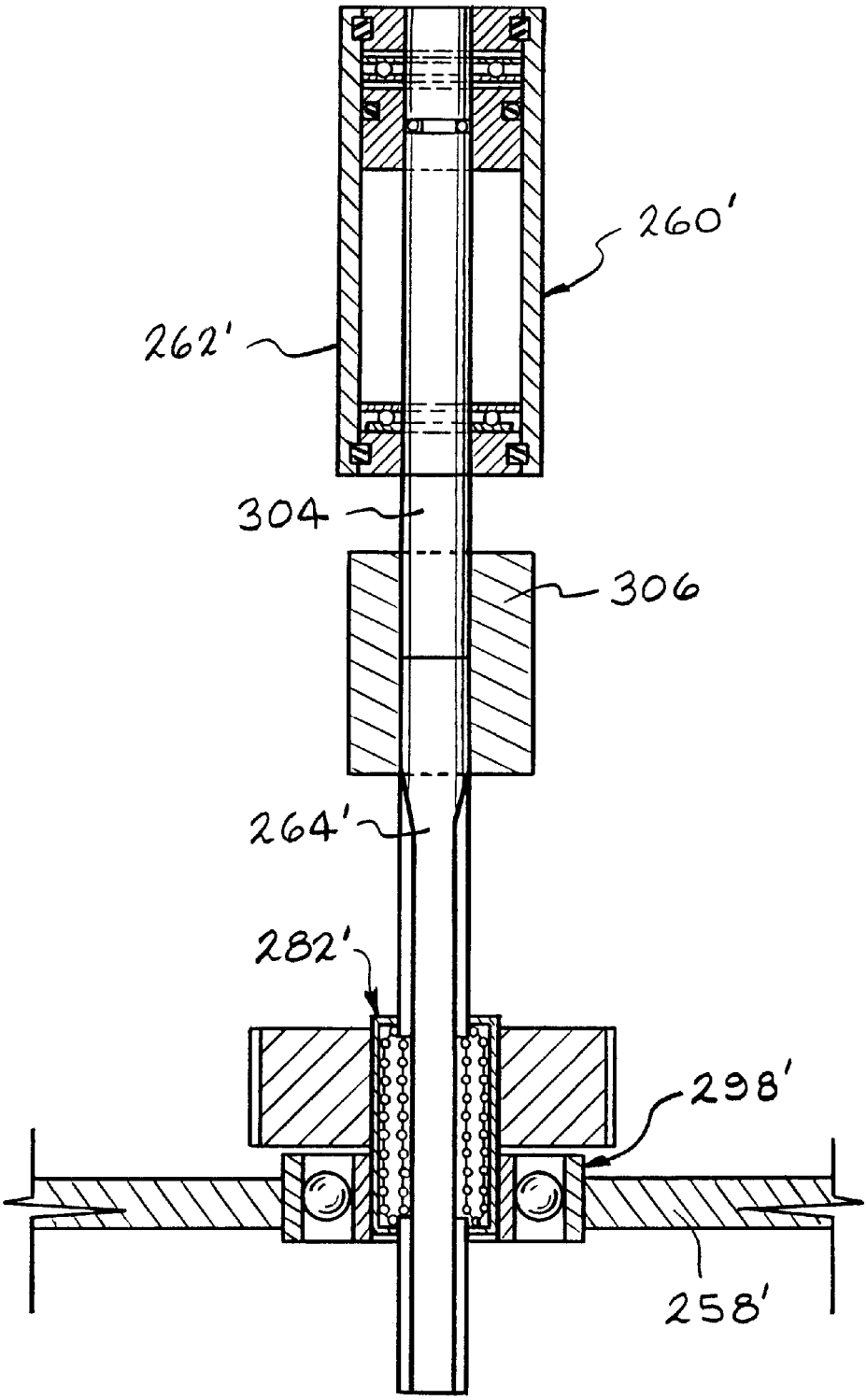

FIGS. 7A–7D diagrammatic views illustrating another aspect of the nesting operation in the system and method of FIGS. 1–4;

FIG. 8 is a diagrammatic view illustrating another aspect of the operation of the system of FIGS. 1–4;

FIGS. 9 and 10 are diagrammatic views further illustrating operation of the system of FIGS. 1–4;

FIG. 11 is a top plan view of the conveyor for use in the system of FIGS. 1–3;

FIG. 12 is a side elevational view of the conveyor of FIG. 11;

FIG. 13 is an end elevational view of the conveyor of FIG. 11;

FIG. 14 is a perspective view of a controlled tool assembly for use in the system of FIGS. 1–3;

FIG. 15 is a longitudinal sectional view of a portion of the assembly of FIG. 14; and FIG. 16 is a longitudinal sectional view of an alternative form of the tool assembly of FIGS. 14 and 15.

DETAILED DESCRIPTION OF THE ILLUSTRATED EMBODIMENT

Referring to FIGS. 1 and 2 there is shown a system 10 according to the present invention for continuous or "on-the-fly" scanning, nesting and cutting sheet material such as cloth. The system 10 of FIGS. 1 and 2 is a fully integrated conveyor cutter that automatically scans the material to determine flaws, reorganizes the pattern or "nest" to be cut based on the flaw locations, and cuts the parts around the flaws. The system is continuous in that all of the foregoing can be done while the material is moving.

Sheet material 12 at a storage location 14 is fed by means of roll 16 to an inspection station 18 where it is inspected to determine the existence and location of flaws in the sheet material. Inspection station 18 includes a table or platform 20 providing a substantially planar surface for supporting a section of the sheet material to be inspected. In the system shown, inspection is performed by a video camera 22 which scans the section of sheet material on platform 20 to obtain a video image transmitted via line 24 for use by the system control for reorganizing the pattern or "nest" to be cut based on flaw locations. In other words, the section of sheet material 12 in the scanning area of camera 22 is video analyzed to determine the location of unusable sections of the material, i.e. flaws, whereupon the pattern to be cut is then reorganized or renested based upon the information provided by the video image. This allows for the maximum material utilization to be achieved in the cutting process.

In particular, tape or other suitable type marks 26*a*–26*d* are applied to the table surface to define a 1 meter in the x axis by 1.5 meters in the y axis rectangle. The x axis is along the table 20 and the y axis is across the table. The camera 22 is adjusted by tilting it and moving it up or down so that these tape marks are aligned with a rectangle which is superimposed over the camera image as displayed on the computer monitor. The distance in the x axis from the tape mark closest to the conveyor to the laser pointer or other reference on the gantry (downstream of table 20 and which will be described) when the gantry is at table home, i.e. a reference position, is entered into a configuration file on the computer as the camera x offset. The distance in the y axis from the lower most tape mark to the laser pointer is entered as the y camera offset. In this way the size and relative position of the camera image is known in relation to the gantry.

Figure 5:
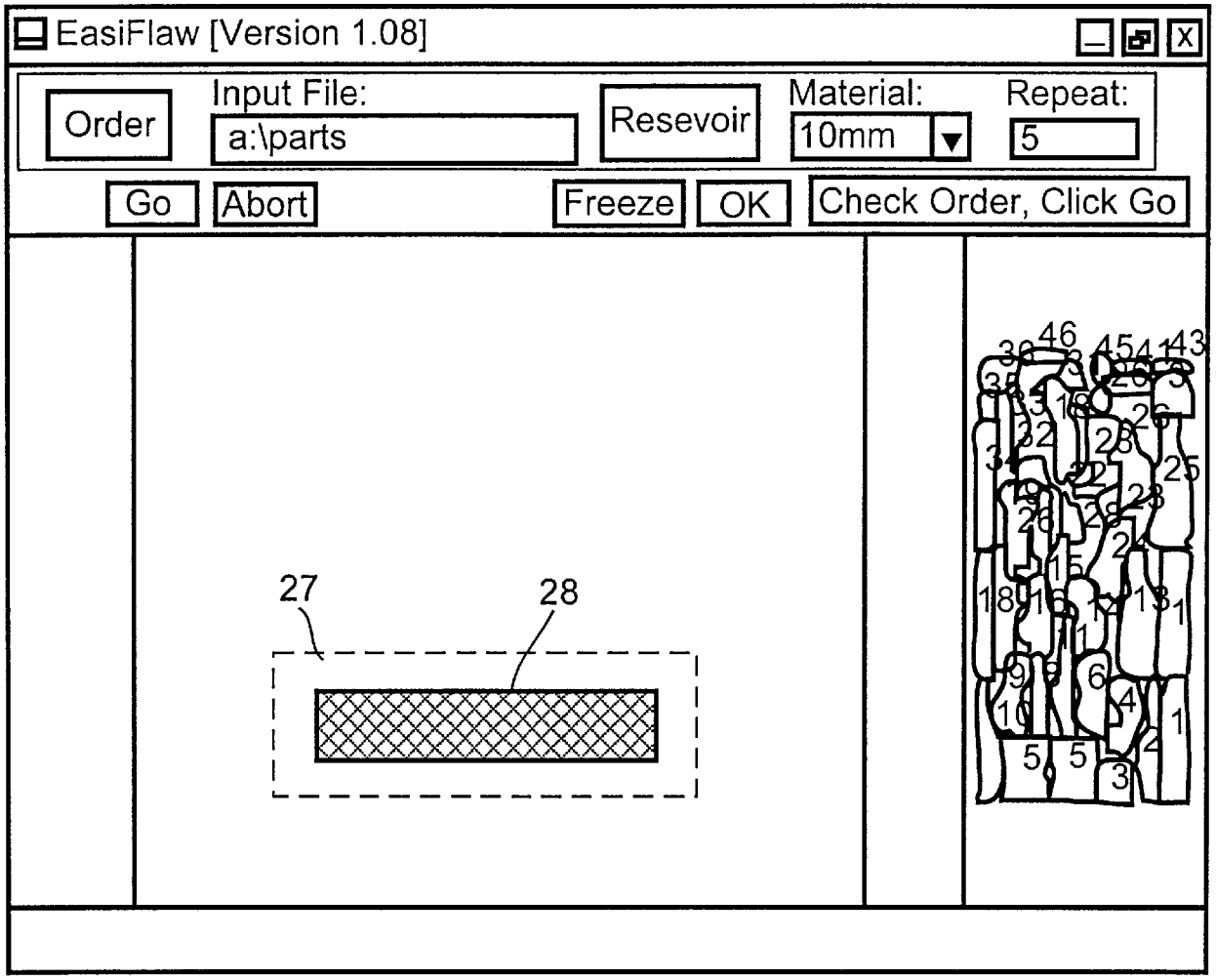
FIG. 5 is a diagrammatic view illustrating the flaw scanning aspect of the operation of the system of FIGS. 1–4.

The operator inputs flaws using camera 22 in the following manner. The camera image of the fabric moving onto the conveyor is displayed to the operator and updated on a regular basis (approx. 1/sec.) using a library of software functions provided by the frame grabber manufacturer. The frame grabber is an interface between video camera 22 and the software. When the operator sees a flaw on the computer screen, a mouse is used to click on a button which first stops the conveyor and then freezes the camera display. While the conveyor is stopped the gantries can continue to cut if there are parts in the cut zone. As shown in FIG. 5, the operator uses the mouse to draw a rectangle 27 around the flaw 28 by clicking on two opposite corners of the rectangle. Once the rectangle is drawn, the operator clicks another button which enters the flaw into the system. The operator at that time may enter another flaw or click on a button to restart the conveyor and camera. Once the flaw is input into the system and is in the nesting area, the software does trial tests of several methods and selects the one which results in the best material utilization, all of which will be described in detail presently.

Thus, using any of various inspection arrangements, including also a digitizing table well-known to those skilled in the art, the system inspects successive sections of the sheet material 12 as they pass through inspection station 18 prior to cutting or other operations being performed on the sheet material. The inspecting of the sheet material and renesting of the cutting patterns based on the flaw locations can be done at the same time while cutting operations are being performed.

The sheet material 12 is transferred from inspection station 18 to a conveyor 30 where operations such as cutting are performed on the sheet material as it is moved along conveyor 30 in a manner which will be described. Optionally an accumulator 32 comprising rollers 34, 36 and 38 can feed the sheet material from inspection station 18 to conveyor 30 to provide a time delay or interval of sufficient magnitude to provide enough time between the inspection, i.e. video scanning, and the cutting operations performed on conveyor 30 to enable the system computer control to automatically re-nest the cutting patterns in the event flaws are detected in the sheet material.

Conveyor 30 includes a moving belt 40 which supports and conveys the sheet material 12 along the path indicated by arrow 42 in FIG. 1 from an input end 44 to an output end 46. Conveyor 30 will be shown and described in further detail presently. While sheet material 12 is moved by conveyor 30 along path 42 operations such as cutting are performed on the sheet material by at least one operation means movable in directions substantially parallel to and substantially perpendicular to path 42. In the system shown, two such operation means generally designated 50 and 52 are provided, and each operation means comprises a gantry means movable longitudinally along conveyor 30, a head means movable along the gantry means laterally of conveyor 30 and an assembly on the head means for moving a tool such as a cutting blade into and out of engagement with and in different orientations with respect to the sheet material 12. In particular, the first operation means 50 comprises a gantry 54 movable along rails or similar supports (not shown in FIGS. 1 and 2) extending longitudinally of the conveyor frame and driven by suitable motor means (not shown). A head 56 is movably carried by gantry 54 and driven back and forth along gantry 54 by suitable motor means (not shown). The aforementioned tool assembly, which will be shown and described in detail presently, is carried below head 56. Similarly, the second operation means 52 comprises a gantry 60 movable along the aforementioned rails or similar supports on the conveyor frame and driven back and forth thereof by suitable motor means. A tool assembly is carried below head 62. Gantry 54 is the one closest to table 20 and is used as the reference in calibrating camera 22 as previously described.

Gantries 54 and 60 are movable longitudinally of conveyor 30 toward and away from each other under system control as will be described. Both gantry style cutters 50 and 52 are operable for cutting "on-the-fly". In other words, either or both cutters 50 and 52 move relative to conveyor 30 and to each other to operate on the sheet material 12 simultaneously with movement of the sheet material along conveyor 30 in the direction of arrow 42 in FIG. 1.

Conveyor 30 is a vacuum or suction hold down conveyor table wherein suction is provided along a portion of the path for sheet material 12 travelling along conveyor 30. The hold-down or suction portion is delineated by the broken line area designated 70 in FIG. 1. The material of conveyor belt 40 is air permeable as will be described presently to facilitate the hold-down of material 12. The portion of the conveyor path between output 46 and the edge of hold-down region is a non-suction area designated 76 which serves as a pick-up area for finished product.

During the foregoing operation, the speed of conveyor belt 40 and the speed, direction and mode of operation of either or both gantries 54 and 60, heads 56 and 62 and tool assemblies are controlled all according to a predetermined pattern of operation for the end product to be obtained from the sheet material. This can include, in accordance with the present invention, adjusting the pattern as determined by the existence and location of flaws in the sheet material as a result of the scanning or similar operations performed at inspection station 18.

When a roll of sheet material 12 is finished, a butt seamer 80 is employed to join the end of the first roll to the beginning of a subsequent roll 82 in a known manner. The resulting seam will appear as a flaw, and the system will re-nest the pattern to be cut around the butt joint.

The operation of the system of FIGS. 1 and 2 is illustrated further in FIG. 3. As previously described, conveyor belt 40 moves sheet material 12 to be cut over the conveyor table. The two gantry style cutters 50 and 52 cut the fabric synchronously with the movement or conveyance of the fabric to be cut. This results in double "cutting on the fly".

Cutter 50 has the ability to cut in the area designated 90 in FIG. 3, cutter 52 has the ability to cut in the area designated 92 and both cutters 50 and 52 have the ability to cut in the overlap area designated 94. Encoders (not shown) operatively associated with cutters 50 and 52 and the tracks on which they move provide information on the instantaneous locations of cutters 50, 52 which is monitored by the system software. Thus the software knows when either cutter 50, 52 enters the common area 94. This, in turn, provides a signal to the system control to prevent the other gantry from entering area 94 at that time. Cutters 50 and 52 also are provided with proximity sensors 100 and 102 operatively coupled to the system control for providing "crash" protection to stop and shut off both cutters 50, 52 if they come too close to each other during the foregoing operation.

Figure 4:
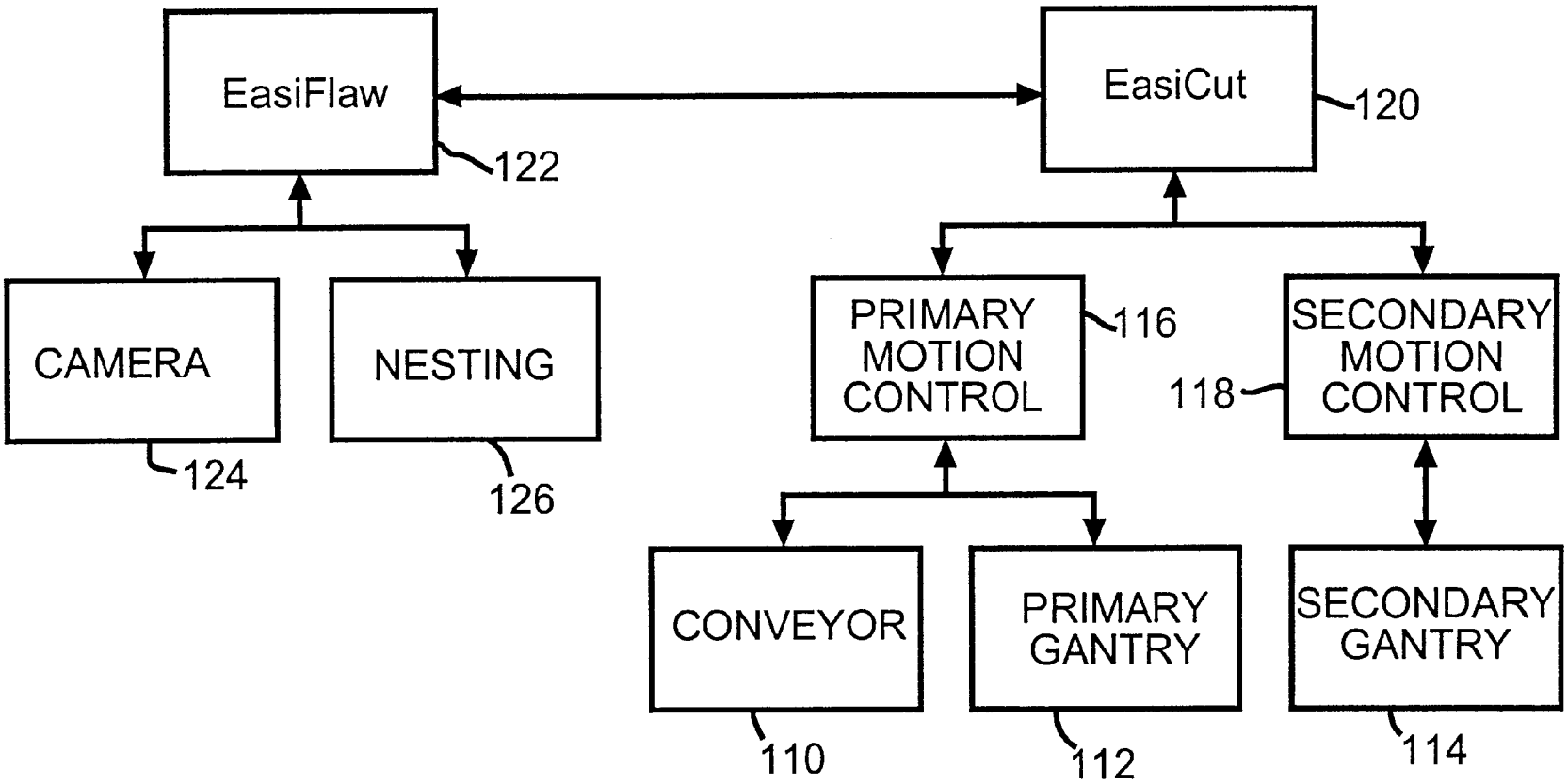
FIG. 4 is a block diagram of the control for the system of FIGS. 1–3.

A control system for the arrangement of FIGS. 1–3 is shown in FIG. 4 and includes motion control hardware components 110, 112 and 114 for conveyor 30, gantry 50 and gantry 52, respectively. In accordance with a preferred mode of the present invention, gantry 52 is slaved to gantry 50, i.e. gantry 50 gives gantry 52 "permission" to move during operation. The primary and secondary motion control software is represented at 116 and 118, respectively. Control over the cut files is provided by software component 120 which in turn receives data and commands from the flaw monitoring software 122 illustrated in connection with FIG. 5 in association with the camera operation 124 previously described and nesting operation 126 which will be described in detail presently.

Cutting on the fly is accomplished by using the functionality provided by the motion control hardware to link axis. The X axis of the gantries 50, 52 are linked to the conveyor axis so that motion commanded on the X axis is done relative to motion commanded on the conveyor axis. The gantry X axes are parallel to the longitudinal axis of conveyor 30. To keep the system modular and expandable, three motion control boards are used, one for the conveyor and one for each of the two gantries. These are indicated at 110, 112 and 114 in FIG. 4. While only the one conveyor motion control board actually controls the conveyor motor, the two gantry control boards are configured to have phantom axes which are programmed to have a motion profile which mimics the actual conveyor axis. The X axis on each gantry is linked to the phantom axis on the same motion control board. In particular, the primary control 116 always has information on movement of conveyor 30 along the X axis, i.e. movement of conveyor 30 along its longitudinal axis, and primary control 116 sends a software message to each gantry hardware control component 112 and 114 so that each gantry control has that conveyor movement information. By virtue of the foregoing this information can be provided advantageously without hardwire connection between the conveyor and gantry controls. Alternatively, the system can obtain the necessary information via an encoder associated with conveyor 30 and hardwire connections to controls 112 and 114.

The actual conveyor axis is synchronized with the phantom conveyor axis described above in the following manner. The motion control components 110, 112 and 114 are connected with a synchronization wire so that the motion commanded on each board begins at the same time. While the voltage level on the synchronization line is set to the ready state, each board is programmed to make identical motions (in the phantom axes), but the motions do not begin until the synchronization line changes to the go state. In order words, the actual velocity and acceleration of conveyor 30 is identical in each of the phantom axes for the gantry controls 112 and 114. Once all the boards have been programmed, the synchronization line is changed to the go state and all boards begin the motion at the same time. In this way any number of motion control components can be synchronized, therefore any number of gantries or other devices could be added to the system.

Crash avoidance in the common overlapping addressable area 94 shown in FIG. 3 is accomplished in the following manner. Since each gantry 50, 52 is capable of addressing the center area 94 of the conveyor 30, a method of preventing both gantries from entering this area at the same time and thus crashing is provided by way of software communication between the primary gantry and secondary gantry under control of software components 116 and 118. The secondary gantry communicates to the primary gantry the amount of conveyor space it needs to cut the parts it has been programmed to process. The primary gantry releases conveyor space to the secondary gantry after it completely cuts all of its parts in that area. Since the released area is relative to the conveyor belt, as the conveyor moves the released area decreases and the secondary gantry may need to move in order to stay in the released area.

By way of example, in an illustrative system, each motion control component 110, 112 and 114 is a DSP Series Motion Controller commercially available from Motion Engineering Inc. under the designation Model LC/DSP.

The software component 120 in the system of FIG. 4 provides the basic interface to the operator of the machine in allocating operations of the cutters 50 and 52 for splitting a particular job. Component 120 imports a cut file which typically would be used by a single headed machine and therefore must split the file so that each gantry 50, 52 processes part of the whole job. Such a cut file is illustrated in FIG. 8. The method used to split the job will depend on the specific requirements of the complete machine. In particular, splitting the job can be along the entire length of the job so that parts on the top and bottom half are cut by separate gantries. Optimizing the splitting of the job can be done so that the time required by each gantry to process each half is nearly the same so as to prevent one gantry from unnecessarily waiting for the other gantry to process its parts. Splitting the job can be done by function. Each gantry may have different tools mounted to it so that one gantry may be cutting and the other labeling or one cutting and the other punching, etc.

In the illustrative cut file of FIG. 8, pen speed is the gantry speed when penning which is similar to labelling, move speed is the gantry speed when not penning or cutting, the acceleration and overall speed are that of the gantry, and the cut speed, pressure and overcut data are for the situation where a particular type of tool (here designated R1) is carried by the gantry. The foregoing illustrative data shown is for one gantry and similar data would be shown for the other gantry.

FIGS. 8 and 9 further illustrate the manner in which the system of FIG. 4 controls conveyor 30 and using the software 120 splits the marker into table bites of equal cut times designated 134 and 136, and shown at two different times during movement of the conveyor belt to the left as viewed in FIGS. 8 and 9. Controls 116 and 118 send these two distinct cut files to the motion controllers 112 and 114. Each gantry cutter 50 and 52 is working on non-overlapping table or cut bites, i.e. those designated 134 and 136 in FIGS. 8 and 9, but since the table bites are being conveyed continuously along conveyor table 30 the regions addressed by each gantry cutter 50 and 52 are overlapping.

Figure 6A:
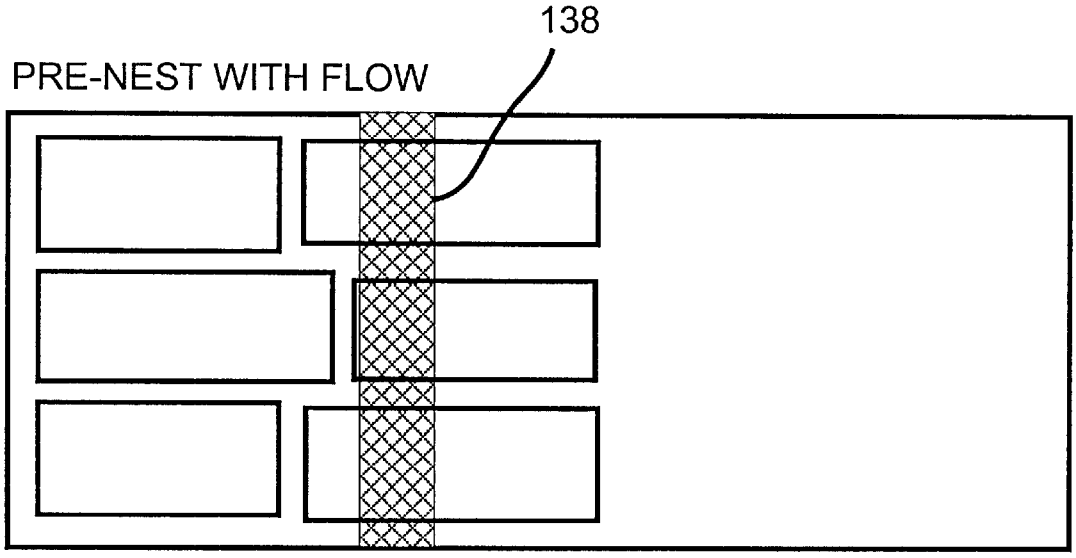
FIGS. 6A and 6B are diagrammatic views illustrating one aspect of the nesting operation in the system and method of FIGS. 1–4.
Figure 6B:
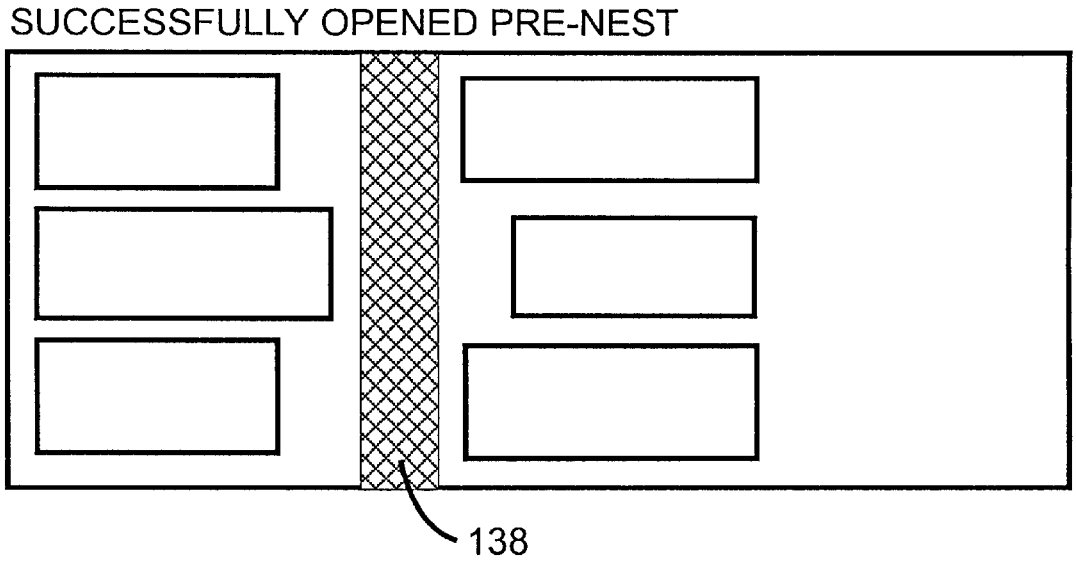

FIGS. 6 and 7 illustrate pattern re-nesting according to the present invention based on flaw information. The system of FIG. 4 recognizes a flaw in sheet material 12 upon scanning by video camera 22 and operator interaction with the "mouse" device and computer screen as described in connection with FIG. 5. Once a flaw has been located, software component 126 of the system of FIG. 4 then re-nests the pattern based on this new flaw information in the following manner. Once the flaw is input into the system and is in the nesting area, the software 126 does trial tests of several methods and selects the one which results in the best material utilization. One method, breaking open pre-nest, is illustrated in FIGS. 6A and 6B where the various rectangles represent patterns of parts to be cut from the sheet of material 136. In the case of a butt-flaw 138, which is a flaw that goes completely across the width of the fabric, the pre-nest of FIG. 6A is opened up so that the parts which would be cut in the flawed material are moved down the material to a good area of material. This is illustrated in FIG. 6B. If the flaw occurs at a location in the pre-nest where there is little overlapping of parts so that only a few parts are affected evenly, the technique of opening up of the pre-nest can result in efficient use of the material.

Another method is removing individual parts affected by a spot flaw which does not extend completely across the fabric. In the case of a spot flaw, the individual parts affected are removed from the nest. It may be possible to insert smaller parts in place of those parts removed.

Figure 7A:
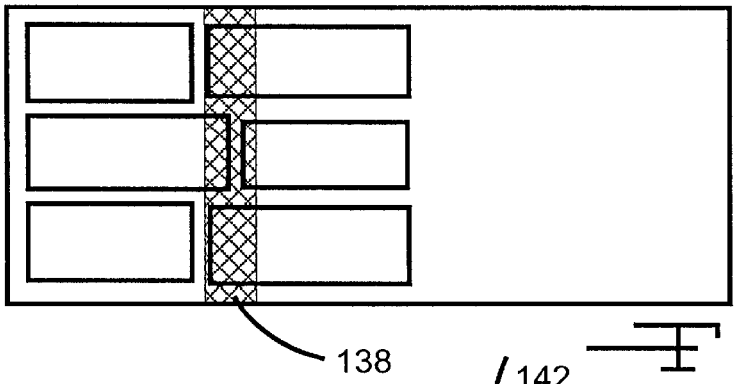
Figure 7B:
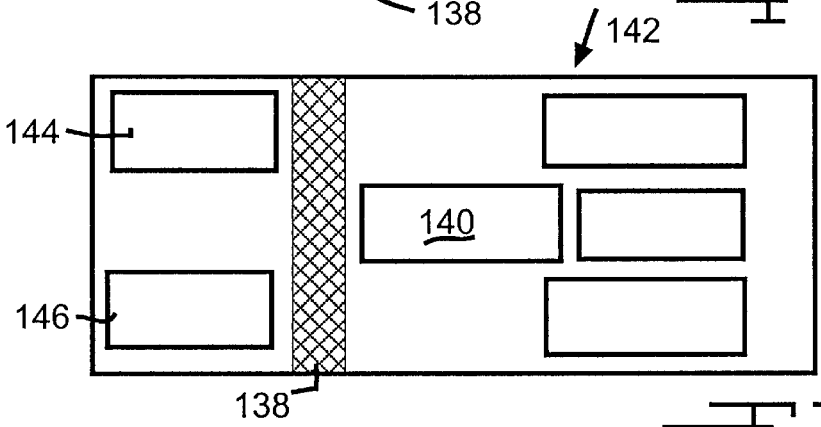
Figure 7C:
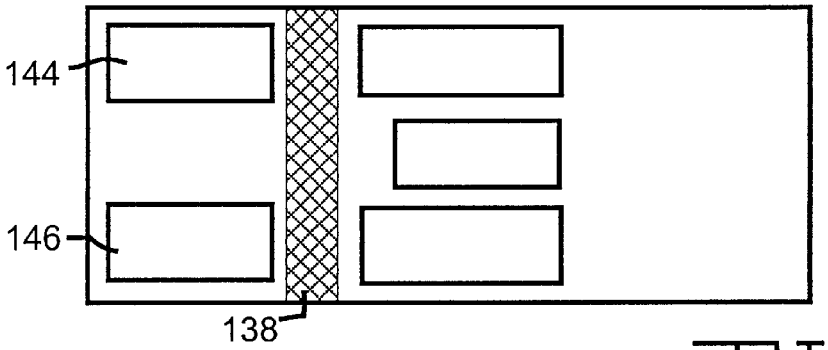
Figure 7D:
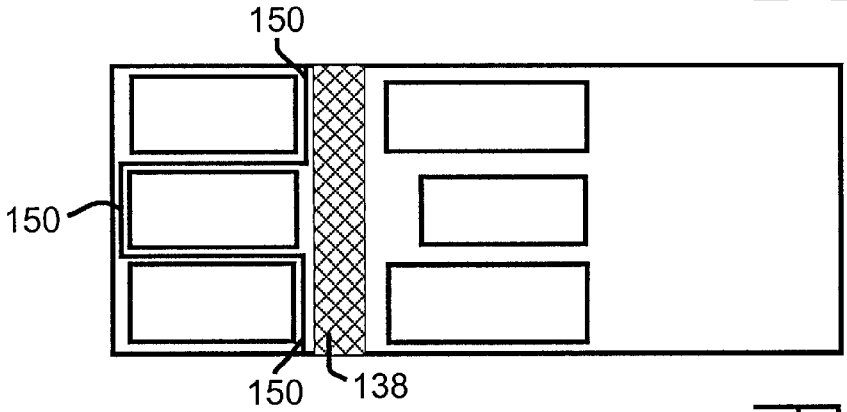

Another method is optimizing the pre-nest and is illustrated in FIGS. 7A–7D. The pre-nest of FIG. 7A is similar to the pre-nest of FIG. 6A. The pre-nest is opened as shown in FIG. 7B. After opening the pre-nest or removing parts at flaws, it is often possible to improve the yield by removing the left most parts of the pre-nest and shifting the pre-nest to the left. Part 140 shown in FIG. 7B is removed from the pre-nest designated 142, whereupon the pre-nest is shifted to the left to provide the optimized pre-nest shown in FIG. 7C. Thus if there is a section of the pre-nest which more closely matches the shape of the flaw, less material will be wasted without disturbing the efficiency of the original nest.

In accordance with another aspect of the nesting process of the present invention there is provided filling in parts using a reservoir. In particular, in certain situations, the nesting results can be improved by adding additional parts to the nest. Since it is not desirable to remove parts from the pre-nest for this purpose, because removing parts from the pre-nest will reduce the efficiency of the pre-nest, a reservoir of parts is provided according to the present invention for this purpose. Parts are added to the reservoir by the following methods. One is parts that are at a flaw and removed by the optimization process. An example is part 140 removed from pre-nest 142 in FIG. 7B. Another is extra parts needed in the manufacturing process, i.e. to compensate for damaged parts. Still another is that the pre-nest can be made intentionally leaving out a few parts and then these parts are added to the reservoir. For example, this can be seen in FIGS. 7B and 7C where the open region between parts 144 and 146 could be the result of intentionally leaving out a small part for this purpose.

Information describing the boundary of the area where parts can be nested into, as well as any flaws in that area and data describing the perimeter of the parts and the maximum number of each part which can be used, is provided to a nesting routine which is standard in the industry. An example of one such routine is found in U.S. Pat. No. 5,146,821 issued Sep. 15, 1992 and entitled "Method of Cutting Blanks From Webs of Material", the disclosure of which is hereby incorporated by reference. An example of the boundary where parts can be nested into is indicated at 150 in FIG. 7D.

Another aspect of the nesting process of the present invention is removing additional parts from pre-nest to provide larger boundary area for nesting. The nesting routine 126 is called several times with different boundary conditions which result from removing additional parts from the pre-nest to provide the nesting routine a larger nesting area and therefore more options for improving the nest results. The nest with the best efficiency is selected from the various techniques.

Once the optimum nest of parts is achieved, it would resemble, for example, the file of parts shown in FIG. 8 whereupon software 120 is called to allocate the tasks between cutters 50 and 52.

The conveyor 30 of FIGS. 1–3 is shown in further detail in FIGS. 11–13. In the arrangement illustrated, a single operation means 170 is shown comprising a gantry 172 and head 174, it being understood that conveyor 30 is useable with either one or two operation means such as the gantry-style cutters. Conveyor 30 comprises a frame 180 supported by legs 182 on a surface 184 such as the floor of a cutting room. A first conveyor belt 190 in the form of air permeable sheet material extends along a first continuous loop-like path including an upper portion which defines a surface 192 upon which the sheet material 12 (not shown in FIGS. 11–13) lays and is supported while operations such as cutting are performed on the material. By way of example, in an illustrative conveyor, belt 190 comprises 1 mm thick urethane or PVC bonded to a woven polyester belt. The belt 190 is provided with holes therethrough so as to be air permeable for a purpose which will be described. A plurality of rollers 196, in particular rubber coated rollers, are rotatably mounted in frame 180 for supporting and guiding movement of conveyor belt 190 along the aforementioned first continuous loop-like path. In addition, a belt tension pulley take-up 198 is mounted in frame 180 and contacts belt 190.

Conveyor 30 further comprises a second conveyor belt 200 in the form of a rigid plastic chain style link belt extending along a second continuous loop-like path wherein at best a portion of the second conveyor belt 200 is in contact or frictional engagement with the first conveyor belt 190. That portion coincides with the upper portion 192 of belt 190 as seen in FIG. 12. A pair of rollers 204 are rotatably mounted in frame 180 for guiding movement of conveyor belt 200 along the aforementioned second continuous loop-like path.

There is provided controlled drive means in frame 180 and in operative engagement with the second conveyor belt 200 for moving belt 200 along the second continuous loop-like path at a controlled speed. The drive means comprises a plurality of toothed pulley wheels 210 fixed on a shaft 212 rotatably mounted in frame 180 at one end thereof and drivenly coupled by a belt or chain type coupling 214 to the output drive shaft 216 of a drive motor-reducer gear combination 218. The speed control for motor 218 is connected to control 110 as previously described. The teeth of pulley wheels 210 drivingly engage the open mesh structure provided by the rigid plastic chain style link belt 200 causing movement of the same. Another plurality of identical pulley wheels 222 are fixed to a shaft 224 rotatably mounted in frame 180 at the opposite end. The idler pulley wheels 222 similarly engage the openings in belt 200 and serve to support and guide the same.

A suction or vacuum chamber 230 is defined by an enclosure within frame 180 in a known manner and is in fluid communication with at least a portion of the path along which sheet material moves between the input and output ends of conveyor 30. A duct 232 converts chamber 230 to a vacuum blower (not shown) or other source of suction in a known manner. Preferably chamber 230 terminates at a location inwardly of the output end 44 of conveyor 30 to define a non-vacuum pick-up area 236 to facilitate removal of finished pieces or product from conveyor 30.

A plurality of plastic runner strips 240 shown in FIG. 11 are mounted in frame 180 for the purpose of providing additional support for the moving belts 190 and 200. A cable carrier 244 for the gantry style plotter cutter 172, 174 is mounted along one side of frame 180 and is operatively contacted by one end of gantry 172 as it moves along conveyor 30.

In operation, the apparatus of FIGS. 11–13 comprises a continuous cutting machine that utilizes a gantry style cutter. The vacuum conveyor table 30 draws air through the two belts 190 and 200 that are supported by the runners 240. The sheet material to be cut is loaded from the left side of the table and held in place by the air vacuum pressure created by suction chamber 230. A cutting knife (not shown) is mounted to head 174 and cuts against belt 190 which is supported by belt 200 which in turn is supported by the runners 240.

The two belts 190 and 200 on conveyor 30 allow a full, pliable cutting surface (provided by belt 190) but maintain rigidity and low friction (belt 200) which conveying under vacuum or suction. The rigid plastic, for example acetal, link belt 200 spans the gap between the plastic runner strips 240, giving a rigid platform with a minimum amount of friction. Also, the link belt 200 tracks or travels straight along the conveyor table better than a non-rigid belt. The operative or driving contact between the two belts 190 and 200 is provided and enhanced by the vacuum or suction.

By way of example, in an illustrative continuous cutting apparatus as shown in FIGS. 11–13, the gantry style cutter 172, 174 was an M9000 high speed platter/cutter commercially available from Eastman Technology Systems Ltd. of Buffalo, N.Y., suction was provided by a 25 hp vacuum motor, and the material cut was 10 mm trilaminate with circular knit scrim. A rapid advance of 30 cm/sec. was used in loading material into position for cutting. During cutting, the move speed of the conveyor belt 190 was 2.350 cm/sec. the system settings were gantry move speed 130 cm/sec., cutter head move speed 130 cm/sec. and acceleration 1.0 g. The "on-the-fly" continuous cutting greatly increased throughout. Cutting to the edge of the material and minimal part buffers resulted in reduced waste.

FIGS. 14 and 15 illustrate a controlled tool assembly 250 for use in the system shown in FIGS. 1–3. A tool assembly 250 is carried on each head 56 and 62, in particular being located below each head, and each tool assembly 250 moved a tool such as a cutting blade into and out of engagement with and in different orientations with respect to the sheet material 12. Referring first to FIG. 14, the tool assembly 250 is mounted in the lower region of the corresponding head by means of a bracket including a main body 252 fixed to the head and leg numbers 254, 256 and 258 extending therefrom. A pneumatic cylinder 260 has the housing 262 thereof fixed to bracket leg 254 and is characterized by the piston rod thereof comprising a spline shaft 264 having a longitudinal axis and extending out from housing 262 and terminating in a lower end as viewed in FIG. 14. Cylinder 260 is operated by a controlled source of pressure carried by the gantry-style cutter on which tool assembly 250 is mounted, the operation being controlled by the gantry control board, i.e. one of the controls 112 and 114 shown in FIG. 4. A tool means generally designated 268 in FIG. 14 is mounted on the lower end of spline shaft 264. In the tool assembly shown, tool means 268 comprises a blade in the form of a round knife. Alternatively, tool means 268 can comprise a drag knife, a high pressure water jet cutter, a laser cutter, an ultrasonic cutter, or a round punch or similar marking implements.

Tool assembly 250 further comprises motor means 274 in the form of a theta axis servo rotational motor, the housing 276 of which is fixed to bracket by 256. A coupling member in the form of a theta axis pulley 280 is fixed to spline shaft 264 by means of a spline shaft nut 282. A coupling means in the form of a belt 286 operatively engages pulley 280 and the output shaft 290 of motor 274 for causing rotation of spline shaft 264 in response to rotation of motor output shaft 290. The rotational movement of servo motor 274 is controlled by the gantry control board, i.e. one of the controls 112 and 114 shown in FIG. 4.

Thus, operation of pneumatic cylinder 260 moves spline shaft 264 to force the tool 268 into sheet material 12, and operation of motor 274 changes the orientation of tool 268 relative to the longitudinal axis of spline shaft 264. Tool assembly 250 features spline shaft 264 integrated into the structure of pneumatic cylinder 260 to act as the rod thereof. This allows rotational orientation of the cylinder rod to be controlled by means of servo motor 274.

FIG. 15 shows in further detail how spline shaft 264 is incorporated to become the rod of pneumatic cylinder 260. This allows low friction rotational movement of the piston/rod assembly as cylinder 260 is actuated. Torque is transmitted via belt 286 from servo motor 274 to pulley 280. Since pulley 280 is rigidly connected to nut 282 of spline shaft 264, the rotational load is ultimately transferred to the tool 268 at the lower end 294 of spline shaft 264. The recirculating ball bearings in spline shaft nut 282 allow very low friction movement of shaft 264 even under torque loads. The ball bearings in spline shaft nut 282 increase wear life, and nut 282 provides an improved holding of the tool in contrast to a mere bushing which would have play. It is important to hold the tool as precisely as possible to achieve a sharp, accurate cut in the material. This is enhanced by the accuracy and tolerance provided by the ball bearings in nut 282. The piston 296 of pneumatic cylinder 260 is attached to spline shaft 264 in a manner allowing the shaft to rotate independently of piston 296. The lateral loads are isolated from the endcaps of pneumatic cylinder 260 by the bearing 298 which is mounted in bracket leg 258. To prevent the pneumatic cylinder 260 from experiencing excess friction while either fully extended or fully retracted, thrust bearings 300 are located within housing 262 at opposite ends thereof. By way of example, spline shaft nut 282 is a standard ball spline type LT model 200LE commercially available from THK.

FIG. 16 shows an alternative arrangement wherein spline shaft 264' and cylinder shaft 304 are separate and joined by a coupling 306. The portion of the shaft in cylinder 262' is subject to wear and can be replace separately by virtue of coupling 306 without having to replace the entire spline shaft.

It is therefore apparent that the present invention accomplishes its intended objects. While embodiments of the present invention have been described in detail, that is done for the purpose of illustration, not limitation.

What is claimed is:

1. A system for performing operations including cutting on sheet material including cloth comprising:

a) means for inspecting sheet material to determine the existence and location of flaws in the sheet material;

b) conveyor means for moving sheet material along a path between a input and an output;

c) first operation means movable in directions substantially parallel to and substantially perpendicular to said conveyor path for performing operations on the sheet material along various contours as it is moved by said conveyor means along said path;

d) first operation control means associated with said first operation means for controlling the speed, direction and mode of the operations performed by said first operation means including movement of the first operation means simultaneously with movement of the sheet material along the path by the conveyor means; and e) control means operatively coupled to said means for inspecting and connected in controlling relation to said conveyor means and to said first operation control means for controlling the speed of said conveyor means and for determining the operations to be performed by said first operation means in accordance with a predetermined pattern of operations for the sheet material wherein the various contours are included in the pattern, said control means adjusting the pattern in accordance with the existence and location of flaws in the sheet material as determined by the means for inspecting and said control means causing said first operation means to per form operations on the sheet material synchronously with movement of the sheet material along the path by the conveyor means.

2. A system according to claim 1 further including:

a) second operation means movable in directions substantially parallel to and substantially perpendicular to said conveyor path in spaced relation to said first operation means for performing operations on the sheet material as it is moved by said conveyor means along said path; and b) second operation control means associated with said second operation means for controlling the speed, direction and mode of the operations performed by said second operation means including movement of the second operation means simultaneously with movement of the sheet material along the path by the conveyor means;

c) said control means being connected in controlling relation to said second operation control means, said control means determining the operations to be performed by said second operation means in accordance with a predetermined pattern of operations for the sheet material, said control means causing said second operation means to perform operations on the sheet material synchronously with movement of the sheet material along the path by the conveyor means, and said control means determining the portions of the operations to be performed by said first and second operation means.

3. A system for performing operations including cutting on sheet material including cloth comprising:

a) means for inspecting sheet metal to determine the existence and location of flaws in the sheet material;

b) conveyor means for moving sheet material along a path between a input and an output;

c) first operation means movable in directions substantially parallel to and substantially perpendicular to said conveyor path for performing operations on the sheet material along various contours as it is moved by said conveyor means along said path;

d) conveyor control means connected in controlling relation to said conveyor means for controlling the operation of said conveyor means including the speed of movement of said conveyor means;

e) first operation control means associated with said first operation means for controlling the speed, direction and mode of the operations performed by said first operation means;

f) primary motion control means connected in controlling relation to said conveyor control means and to said first operation control means for coordinating movement of the first operation means with movement of the conveyor means during movement of the sheet material along said path and for causing said first operation means to perform operations on the sheet material synchronously with movement of the sheet material along the path by the conveyor means; and g) system control means operatively coupled to said means for inspecting and connected in controlling relation to said primary motion control means for determining the operations to be performed by said first operation means in accordance with a predetermined pattern of operations for the sheet material wherein the various contours are included in the pattern and said system control means adjusting the pattern in accordance with the existence and location of flaws in the sheet material as determined by the means for inspecting.

4. A system according to claim 3 further including:

a) second operation means movable in directions substantially parallel to and substantially perpendicular to said conveyor path in spaced relation to said first operation means for performing operations on the sheet material as it is moved by said conveyor means along said path;

b) second operation control means associated with said second operation means for controlling the speed, direction and mode of the operations performed by said second operation means;

c) secondary motion control means connected in controlling relation to said second operation control means for coordinating movement of the second operation means with movement of the conveyor means during movement of the sheet material along said path and for causing said second operation means to perform operations on the sheet material synchronously with movement of the sheet material along the path by the conveyor means; and d) said system control means being connected in controlling relation to said second secondary motion control means, said system control means determining the operations to be performed by the second operation means in accordance with a predetermined pattern of operations for the sheet material, and said system control means determining the portions of the operations to be performed by said first and second operation means.

* * * * *